US007419523B2

(12) United States Patent
Sjöberg et al.

(10) Patent No.: US 7,419,523 B2
(45) Date of Patent: Sep. 2, 2008

(54) DEVICE FOR A VACUUM CLEANER

(75) Inventors: Göran Sjöberg, Kungsängen (SE); Håkan Miefalk, Järfälla (SE); Fredrik Bergling, Stockholm (SE)

(73) Assignee: Aktiebolaget Electrolux, Stockholm (SE)

( * ) Notice: Subject to any disclaimer, the term of this patent is extended or adjusted under 35 U.S.C. 154(b) by 496 days.

(21) Appl. No.: 10/505,812

(22) PCT Filed: Feb. 26, 2003

(86) PCT No.: PCT/SE03/00315

§ 371 (c)(1),
(2), (4) Date: Feb. 18, 2005

(87) PCT Pub. No.: WO03/075732

PCT Pub. Date: Sep. 18, 2003

(65) Prior Publication Data

US 2005/0125943 A1 Jun. 16, 2005

(30) Foreign Application Priority Data

Mar. 8, 2002 (SE) ..... 0200767

(51) Int. Cl.
*B01D 45/12* (2006.01)

(52) U.S. Cl. ..... 55/429; 55/430; 55/459.1; 55/466

(58) Field of Classification Search ..... 55/429, 55/430, 459.1, 466, DIG. 3
See application file for complete search history.

(56) References Cited

U.S. PATENT DOCUMENTS

| | | | | |
|---|---|---|---|---|
| 3,452,368 | A * | 7/1969 | Couper | 4/484 |
| 3,895,929 | A * | 7/1975 | Jysky et al. | 55/334 |
| 5,090,976 | A | 2/1992 | Dyson | |
| 6,168,641 | B1 | 1/2001 | Tuvin et al. | |
| 7,171,725 | B2 * | 2/2007 | Sjoberg et al. | 15/348 |

FOREIGN PATENT DOCUMENTS

| | | |
|---|---|---|
| EP | 0322387 | 6/1989 |

* cited by examiner

*Primary Examiner*—Robert A Hopkins
(74) *Attorney, Agent, or Firm*—Pearne & Gordon LLP

(57) ABSTRACT

This invention relates to a device for a vacuum cleaner comprising a cyclone chamber (10) and a collecting container (21) arranged in association with the cyclone chamber for particles separated by the cyclone. The cyclone chamber comprises an inlet (14) for dust laden air, a particle outlet (17) for particles separated by the cyclone and on outlet (15) for cleaned air. The lastmentioned outled is connected to a vacuum source and the particle outlet (15) for cleaned air. The lastmentioned outled is connected to a vacuum source and the particle outlet (17) is via a tube (18) ending in the collecting container (21). The collecting container comprises a dust bag (37) for collecting the dust particles which is a part of a continuous tube (31) of non air pervious material intended to create several bags. The invention also relates to a cassette intended to be used at the device.

13 Claims, 2 Drawing Sheets

DEVICE FOR A VACUUM CLEANER

This application claims the benefit of International Application No. PCT/SE03/00315, which was published in English on Sep. 18, 2003.

This invention relates to a device for a vacuum cleaner comprising a cyclone chamber and a collecting container arranged in association with the cyclone chamber for particles separated by the cyclone, the cyclone chamber comprising an inlet for dust laden air and an outlet for particles separated by the cyclone as well as an outlet for cleaned air the lastmentioned outlet being connected to a vacuum source and the particle outlet via a tube ending in the collecting container. The invention also relates to a cassette to be used at the device.

Vacuum cleaners in which the particles are separated by means of cyclone action are previously known, see for instance U.S. Pat. No. 4,463,748. For such vacuum cleaners conventional filter bags in which the particles are separated and collected are not used. These vacuum cleaners are instead provided with a container to which the particles are successively distributed when the air/particle flow is rotated in a cylindrical separation chamber the particles by influence of the centrifugal forces being thrown towards the periphery of the chamber where the inlet of the container is placed. When the container has been filled it is removed from the vacuum cleaner and is emptied in a dust bin or the like. However, this is from an hygienic point of view not particullarly satisfying and consequently other arrangements have been proposed, see U.S. Pat. No. 6,168,641. At the lastmentioned arrangement the collecting container encloses a bag, for instance a plastic bag, in which the particles are collected. When the bag has been filled it is removed and thrown together with the content. This means a more hygienic handling of the dust bag with its content than the previously known arrangements.

For conventional vacuum cleaners, i.e. such vacuum cleaners where separation takes place because the air flow is directed through the filter material of the bag it has previously been suggested, see EP322387, to use a tube shaped, folded filter web placed about an inlet tube in a separate chamber adjacent a bag space. By pulling out the free end of the filter web and closing it by means of a closing device at the same time as the the web is cut off a new bag is formed each time a new bag is to be replaced. Even if such an arrangement gives a simplified handling when changing the bag at conventional vacuum cleaners there is disadvantages with respect to the hygiene since the bag is air permeable which means that dust particles will deposite at the outside of the bag and hence make the operator dirty when handling the bag.

The purpose of this invention is to achieve an improved bag replacement system for a so called cyclone vacuum cleaner and this is achieved by means of a device having the characteristics mentioned in the claims.

Figure 1:
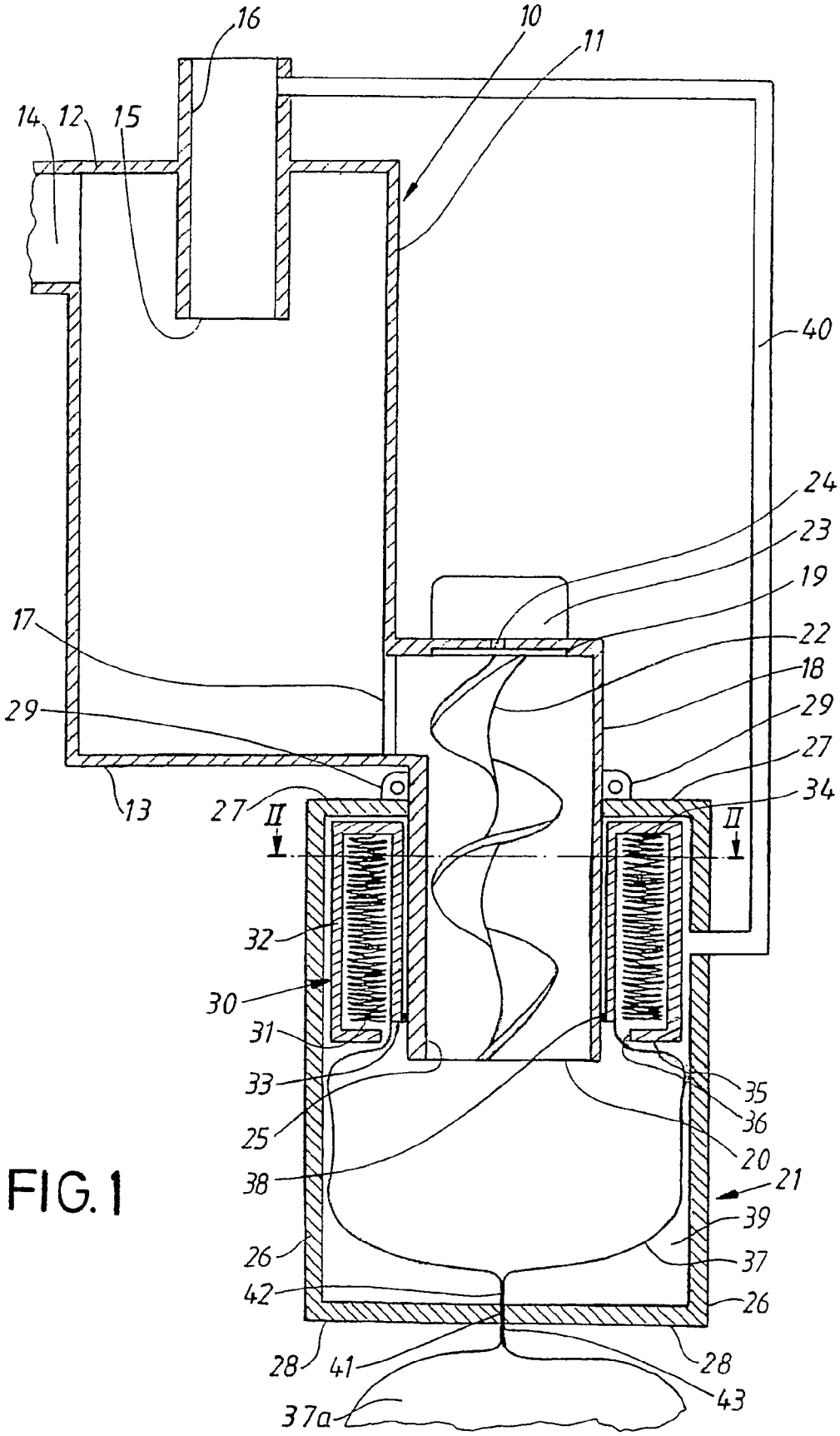
Figure 2:
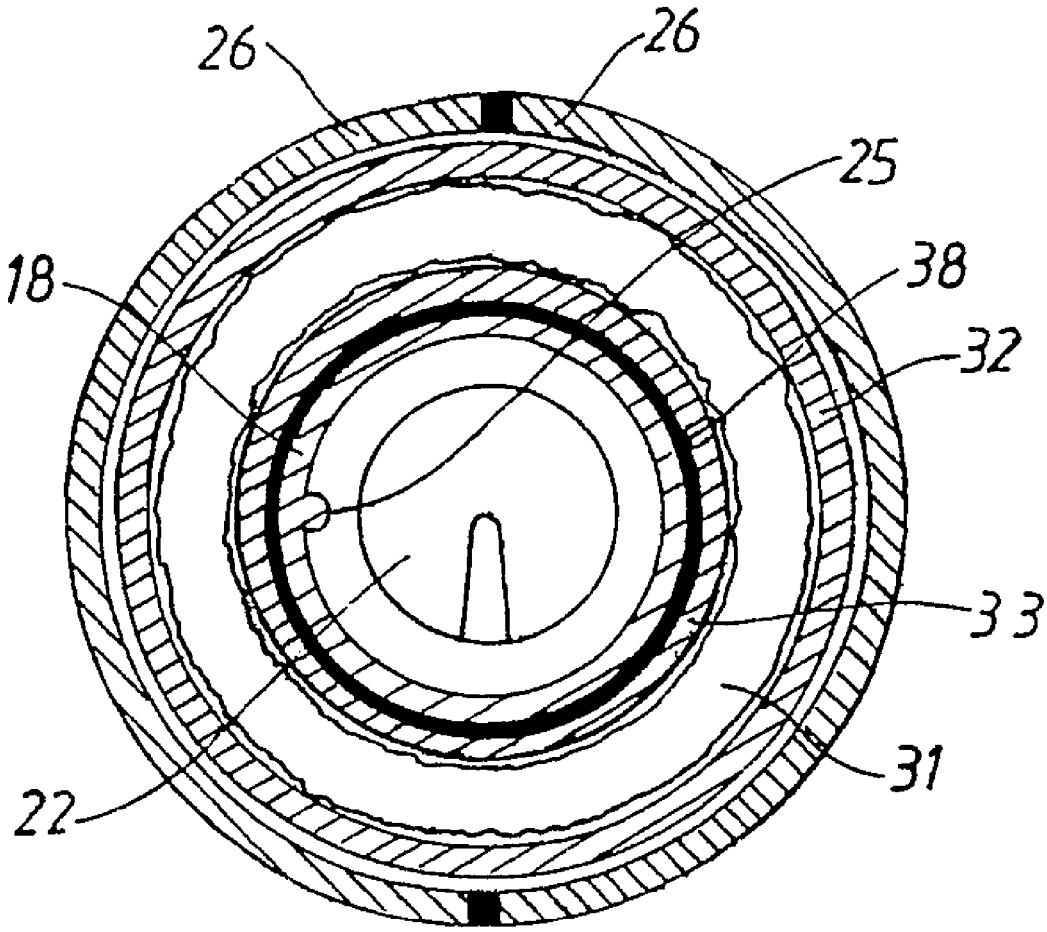

An embodiment of the invention will now be described with reference to the accompanying drawing on which FIG. 1 schematically shows a verticla section through a part of a cyclone vacuum cleaner whereas FIG. 2 is a section on the line II-II in FIG. 1.

As appears from the figures the vacuum cleaner according to the invention comprises a cyclone chamber 10 which is limited by a cylindrical side wall 11 and a first and second end wall 12 and 13 resp. The cyclone chamber has a preferably tangentially directed inlet 14 that is connected to a vacuum cleaner nozzle or the like, not shown, through which dust laden air flows into the cyclone chamber. The cyclone chamber 10 is also provided with an air outlet 15 that is centrally placed and that via a passage 16 is connected to a vacuum source, not shown, such as an electrically driven fan unit. Thus, the air which has been freed from particles leave through the air outlet 15. The passage 16 is coaxial with the cyclone chamber and extends somewhat into the chamber at the central part of the first end wall 12. The cyclone chamber also has a peripheral particle outlet 17 arranged close to the second end wall 13.

The particle outlet 17 continues into a cylindrical tube part 18 that is paralell to the cyclone chamber 10 and is closed at one of its ends by means of a wall part 19 whereas its second free end 20 extends into a collecting container 21 surrounding the tube part 18. The tube part 18 encloses a screw conveyor 22 driven by an electric motor 23 via a shaft 24 extending through the wall part 19. The current or power of the electric motor is sensed and influences in a suitable way the electric circuit, not shown, of the vacuum cleaner. The tube part also has an axially extending ridge 25 streching between the particle outlet 17 and the free end 20 of the tube part 18. The screw conveyor 22, that preferably is made of plastic is flexible in the radial direction and is shaped such that it has an outer diameter that is considerably less than the inner diameter of the tube part 18 which means that the periphery of the screw conveyor has a comparatively large play with respect to the surrounding tube wall and also a certain play to the ridge 5.

The collecting container 21 comprises two tube halves 26 each having a first and second end wall 27, 28 the tube halves each being supported by a hinge 29 arranged at the outside of the tube part 1S. The two first end walls 27 are shaped such that they surrond the tube part 18 whereas the the second end walls 28 together form a bottom in the collecting container. The tube halves 26 can thus be turned from and towards one another in order to admit insertion and removal of a cassette 30 containing a folded tube 31 of a non air permeable material such as plastic.

The cassette 30 has two coaxial sleeve shaped parts 32 and 33 with different diameters the parts at one of their ends being connected to one another by means of an end wall 34 whereby an annular chamber is created between the sleeve shaped parts in which the folded tube is stored. Also at the other end of the sleeves there is an and wall 35 this however being shaped such that a circular slot 36 is formed through which the tube is pulled out in order to form a bag 37 in the collecting container 21.

Between the cassette 30 and the tube part 18 there is an annular sealing 38 such that the inside of the bag is sealed from the space 39 outside the bag. The lastmentioned space is also via a tubular conduit 40 connected to the passage 16.

The tube halves 26 which jointly form the collecting container 21 comprise a sealing and separating device 41 which is placed in the partition plane between the second end walls 28. The lastmentioned device preferably comprises a heat creating means that when the bag is changed forms a welding joint 42 of a new bag 37 at the same time as a welding joint 43 closing the opening of a used bag 37*a* is created and which also separates the bags 37 and 37*a* from one another.

The device operates in the following manner. When the fan unit is started dust laden air will be sucked in tangentially through the inlet 14 into the cyclone chamber 10 thereby creating a vortex which means that the particles in the air will be thrown towards the periphery of the cyclone chamber and leave through the particle outlet 17 whereas the air being free from particles leaves through the air outlet 15 towards the fan unit from which the air, possibly via one or several conventional filters leaves to atmosphere. The separated particles, which from the particle outlet 17 are distributed into the tube part 18, will by means of the rotating screw conveyor 22 successively be moved into the bag 37*a* where they are collected on the bottom of the bag. The ridge 25 and the radial flexibility of the screw conveyor increases the possibility for larger objects to pass through the system to the bag. Allen the bag 37*a* is successively filled the screw conveyor will compact the content in the bag whereby the screw conveyor 22 is exposed to an increased turning resistance which means that the current or power demand of the electric motor 23 increases. By sensing this the fill condition of the bag can be indicated and might be connected to the functions of the vacuum cleaner and for example turn off the vacuum cleaner.

When the dust bag 37*a* has been filled the tube halves 26 are turned from one another after which the bag 37*a* is pulled out such that it is placed immediately outside the collecting container. This means that a part of the tube 31 is pulled out of the cassette 30. Then the two tube halves 26 are closed the and sealing and separating device 41 is activated which means that the opening of the bag 37*a* and the bottom of the bag 37 will be sealed at the same time as the two bags are separated from one another. The vacuum cleaner can then again be activated which means that the subatmospheric pressure created in the tube connection 16, which is greater than the subatmospheric pressure in the bag 37 and which is separated from it by means of the sealing 38, will pull the bag out towards the surrounding walls in the collecting container 21 before the bag again starts to be filled with particles.

When the tube 31 is finished the complete cassette 30 is pulled out from the collecting container 21 and a new cassette is pushed on the tube part 18 after which a suitable length of the tube 31 is pulled out and is sealed at its end by activating the sealing means 41.

It should be pointed out that the welding arrangement described above can be replaced by other types of sealing arrangements for instance by means of tape or clips, sealing by means of mechanical deformation of the plastic material (toggle joint) these devices preferably being combined with a knife for separating the filled bag.

The invention claimed is:

1. Device for a vacuum cleaner comprising a cyclone chamber (10) and a collecting container (21) arranged in association with the cyclone chamber for particles separated by the cyclone, the cyclone comprising an inlet (14) for dust laden air, a particle outlet (17) for particles separated by the cyclone and an outlet (15) for cleaned air the last mentioned outlet being connected to a vacuum source and the particle outlet (17) via a tube part (18) ending in the collecting container (21) characterized in that the collecting container comprises a dust bag (37) for collecting the dust particles which is a part of a continuous flexible tube (31) of non air pervious material intended to create several bags.

2. Device according to claim 1 characterized in that a main part of the tube (31) is supported by means of a removable cassette (30) arranged at one end of the collecting container (21) the tube (31) and the cassette (30) surrounding a part of the tube part (18) that extends into the collecting container (21).

3. Device according to claim 2 characterized in that the cassette (30) is formed by means of two sleeve shaped parts (32, 33) that at one of their ends are connected to one another by means of an end wall (34) whereby an annular chamber enclosing a major part of the tube (31) is created.

4. Device according to claim 2 or 3 characterized in that the part of the cassette (30) that faces the other end of the collecting container (21) is provided with an opening (36) through which the continuous tube (31) extends.

5. Device according to claim 2 characterized in that the part of the cassette (30) that faces the tube part (18) is provided with a sealing (38) that surrounds the tube part and prevents air from entering between the cassette and the tube part.

6. Device according to claim 1 characterized in that the bottom of the vacuum cleaner dust bag (37) on which the particles are collected is a sealed end of the continuous tube, which end by welding is sealed by means of a sealing device (41) arranged at the collecting container.

7. Device according to claim 6 characterized in that the sealing device (41) is provided with means for simultaneously sealing and separating a tube portion from the end of the tube and to seal that end of the tube portion which is closest to the sealing device when the tube portion has been pulled out from the collecting container whereby the tube portion together with its content forms a sealed bag.

8. Device according to claim 1 characterized in that the collecting container (21) by means of an air passage (40) communicates with the air flowing to the vacuum source at a point up-stream the outlet (15) for cleaned air in the cyclone chamber (10).

9. Device according to claim 1 characterized in that said tube part (18) encloses a screw conveyor (22).

10. Device according to claim 9 characterized in that the screw conveyor (22) is driven by an electric motor (23) the current or power demand of the electric motor being used to indicate the fill state in the collecting container (21).

11. Device for a vacuum cleaner comprising a cyclone chamber (10) and a collecting container (21) arranged in association with the cyclone chamber for particles separated by the cyclone, the cyclone comprising an inlet (14) for dust laden air, a particle outlet (17) for particles separated by the cyclone and an outlet (15) for cleaned air the last mentioned outlet being connected to a vacuum source and the particle outlet (17) via a tube part (18) ending in the collecting container (21) characterized in that the collecting container comprises a dust bag (37) for collecting the dust particles which is a part of a continuous flexible tube (31) of non air pervious material intended to create several bags, further characterized in that the device comprises a cassette comprising a housing having two sleeve shaped parts (32, 33) that at both ends are provided with an end wall (34, 35), where at least one of the end walls (34) connects the two sleeves with one another, and whereas the cassette close to the other end wall is provided with an opening (36) through which the tube (31), stored between the sleeves, of non air pervious material can be pulled out from the cassette.

12. Device for a vacuum cleaner comprising a cyclone chamber (10) and a collecting container (21) arranged in association with the cyclone chamber for particles separated by the cyclone, the cyclone comprising an inlet (14) for dust laden air, a particle outlet (17) for particles separated by the cyclone and an outlet (15) for cleaned air, the last mentioned outlet (15) being connected to a vacuum source, and the particle outlet (17) via a tube part (18) ending in the collecting container (21), characterized in that the collecting container comprises a dust bag (37) for collecting the dust particles which is a part of a continuous flexible tube (31) of non air pervious material intended to create several bags; and further characterized in that the dust bag (37) is contained within a cassette that comprises a housing having two sleeve shaped parts (32, 33), at least one of the sleeve shaped parts (32, 33) having an end that is provided with an end wall (35) that is provided with an opening (36) through which the tube (31), stored between the sleeves, of non air pervious material can be pulled out from the cassette.

13. Device according to claim 12 characterized in that at least one of the sleeve shaped parts (32, 33) is provided with an end wall (34) that connects the two sleeves with one another.

* * * * *